US005795044A

United States Patent [19]

Trewhella, Jr. et al.

[11] Patent Number: 5,795,044

[45] Date of Patent: Aug. 18, 1998

[54] DRAWER SAFETY LOCK

[75] Inventors: Stephen W. Trewhella, Jr., Plainwell; James B. Greene, Otsego, both of Mich.

[73] Assignee: Glassmaster Controls Co., Inc., Kalamazoo, Mich.

[21] Appl. No.: 775,830

[22] Filed: Dec. 31, 1996

[51] Int. Cl.[6] ..... A47B 88/00

[52] U.S. Cl. ..... 312/333; 312/334.46; 292/87

[58] Field of Search ..... 312/333, 334.44, 312/334.46; 292/80, 87, DIG. 38

[56] References Cited

U.S. PATENT DOCUMENTS

| | | | |
|---|---|---|---|
| 357,006 | 2/1887 | Hoffmann . | |
| 599,296 | 2/1898 | Hemstreet . | |
| 810,545 | 1/1906 | Krag . | |
| 1,366,451 | 1/1921 | Hawley . | |
| 1,618,126 | 2/1927 | Himmelwright | 312/333 |
| 2,462,397 | 2/1949 | Hendricks . | |
| 3,189,938 | 6/1965 | Saunders . | |
| 3,381,992 | 5/1968 | Friesen | 312/333 |
| 3,397,001 | 8/1968 | Friedman | 292/87 |
| 3,589,778 | 6/1971 | Olson | 312/334.46 X |
| 3,738,728 | 6/1973 | Eckard | 312/333 X |
| 3,850,463 | 11/1974 | Hawkins | 312/333 X |
| 3,851,941 | 12/1974 | Stebe . | |
| 3,888,525 | 6/1975 | Kousens | 312/334.46 X |
| 4,139,249 | 2/1979 | Hillman . | |
| 4,505,526 | 3/1985 | Leck . | |
| 4,979,909 | 12/1990 | Andrews | 312/333 X |
| 5,123,721 | 6/1992 | Seo | 312/333 |
| 5,262,923 | 11/1993 | Batta et al. | 312/333 X |
| 5,344,226 | 9/1994 | Lee | 312/333 X |
| 5,445,451 | 8/1995 | Harmony | 312/333 |

FOREIGN PATENT DOCUMENTS

| | | | |
|---|---|---|---|
| 394279 | 4/1924 | United Kingdom | 312/334.46 |
| 2019668 | 11/1971 | United Kingdom | 312/334.44 |
| 2297788 | 8/1996 | United Kingdom . | |
| 2298231 | 8/1996 | United Kingdom . | |

*Primary Examiner*—Peter M. Cuomo
*Assistant Examiner*—Hanh V. Tran
*Attorney, Agent, or Firm*—Flynn, Thiel, Boutell & Tanis, P.C.

[57] ABSTRACT

A one-piece plastic drawer safety latch for preventing unwanted opening of drawers or the like includes a mounting section mounted to an exterior of the drawer and a latching section which normally projects forwardly toward a front of the drawer and outwardly at an angle relative thereto. The latching section includes a forward facing step which abuts against an opposing surface of a cabinet front wall to prevent complete opening of the drawer. The latching section includes a finger tab which projects out of the cabinet housing when the drawer is partially open such that a user can manually press the latch section inwardly to disengage the step from the cabinet frame and permit complete opening of the drawer.

20 Claims, 5 Drawing Sheets

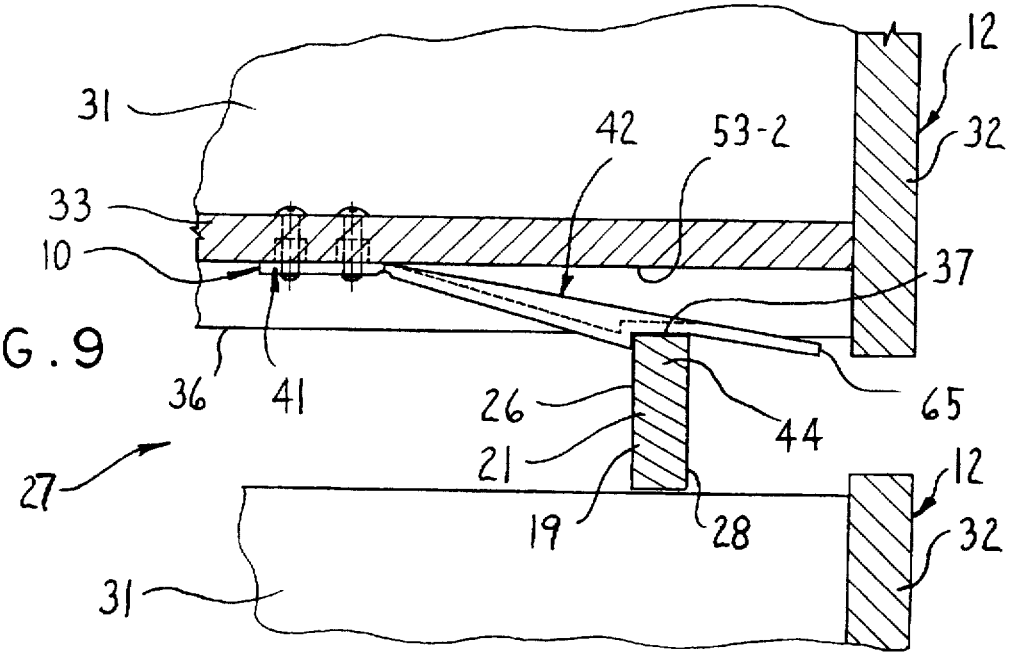
FIG. 9
FIG. 10
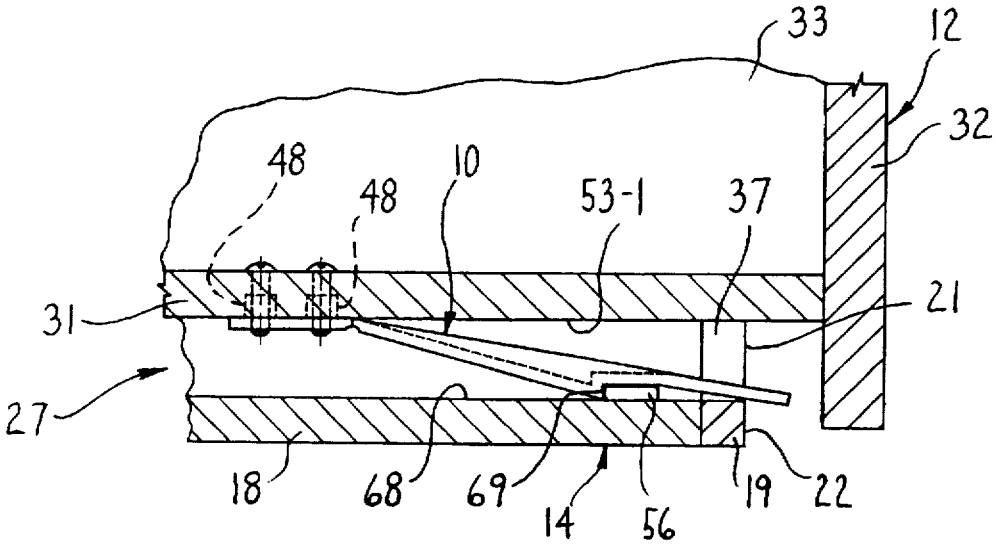

DRAWER SAFETY LOCK

FIELD OF THE INVENTION

The invention relates to a drawer safety lock for preventing unwanted opening of a cabinet drawer and more particularly, to a drawer safety latch which allows partial opening of the drawer but must be manually disengaged before the drawer may be completely opened.

BACKGROUND OF THE RELATED ART

To prevent unwanted opening of cabinet drawers, it is known to provide rearwardly extending drawer safety catches which allow for limited opening of a drawer but which require manual disengagement so as to permit a drawer to be fully opened. Safety catches typically are used in the home to prevent unwanted opening of drawers and cabinet doors by small children. Such catches typically are mounted to an interior surface of a cabinet drawer or to an edge of a door of the cabinet, and typically include a hook or latch which engages a corresponding catch on the cabinet housing when the drawer or door is being closed. During opening of the drawer or door, the latch engages the catch after the door is opened a limited extent. To permit further opening of the drawer or door to a fully open position which allows access to the contents of the cupboard or drawer, a user manually actuates the latch to a position disengaged from the catch such that the drawer or door can be freely opened. Adults and older children can actuate the safety latch without great difficulty, although such latches, particularly in the home, cause greater difficulty for a small child such that the small child is prevented from opening the drawer or door to gain access to potentially harmful products and articles contained therein.

In one known drawer catch as disclosed in U.S. Pat. No. 4,505,526, a flexible hooked element is mounted to and projects rearwardly from a front wall of a drawer into the interior thereof. The hooked element is positioned to engage a catch on a downward facing surface of the cabinet which overlies the drawer. The drawer can be opened a limited amount until the hook engages the catch, at which time the user must manually flex the hook downwardly to disengage the catch. In this arrangement, the hook extends into the interior of the drawer such that it may interfere with access to the drawer interior as well as interfere with the contents thereof.

Additional latching mechanisms are also disclosed for securing a structure within a housing, although these latches do not operate as safety catches which allow limited movement of the structure, much less safety latches that can be readily mounted at various locations on a drawer with a minimum of difficulty. For example, U.S. Pat. No. 3,189,938 discloses a pair of handles which each have a latch mechanism at upper and lower ends thereof and project through a front face of a drawer to secure the drawer in a fully closed position. Each drawer latch is mounted to a single location on the drawer and requires that the latch mechanism extend through the front panel of the drawer for operation thereof.

In another example, U.S. Pat. No. 5,262,923 discloses a latching mechanism for securing a computer disc drive in a disc housing. This latch mechanism engages an aperture formed in the housing adjacent a front edge thereof and fixedly secures the computer disc drive in a single position. The latch extends from an elongate slide rail by which the disc drive is supported in the housing. The latch mechanism is not detachable from the support rail. When engaged with the housing, the latch mechanism only defines a single secured position for the disc drive so as to prevent both forward and rearward movement of the disc drive relative to the housing.

Accordingly, it is an object of the invention to provide a drawer safety latch which is readily mountable and demountable at various locations on exterior surfaces of existing drawers so as to prevent unwanted opening of the drawer by small children. If the drawer is in a moving vehicle such as a motor home or boat, the safety latch also prevents opening by movement of the vehicle. It is another object that the drawer catch be mountable to the exterior of existing drawers either on the side or bottom walls thereof so as to avoid interference with the storage space within the interior of the drawer and be protected from damage. It is a further object that the drawer catch be readily releasable when operated by older children and adults.

In view of the foregoing, the invention relates to a single-piece drawer latch which can be readily mounted to the exterior surface of the side or bottom wall so as to engage existing frame members of the cabinet which extend either vertically or horizontally adjacent to the respective side and bottom wall. More particularly, the drawer latch is preferably a one-piece molded plastic part having a mounting section at one end through which fasteners can be threaded to engage any suitable location on either the side or bottom wall of the drawer. The drawer latch also includes an elongate latching section which is joined in cantilevered relation with the mounting section and extends longitudinally away from the mounting section at an angle relative thereto. The latching section is joined to the mounting section by a reduced thickness hinge section which allows the latching section to resiliently deflect relative to the mounting section.

When the drawer catch is mounted to an exterior mounting surface of the drawer on either of the side or bottom wall, the latch section normally projects outwardly away from the mounting surface and forwardly away from the mounting section toward a front wall of the drawer. The drawer latch is dimensioned so that when it is mounted to the drawer, the drawer latch contacts the adjacent frame member of the cabinet when the drawer is being inserted which thereby deflects the latching section inwardly a small distance to permit unimpeded closing of the drawer.

The latching section also has an abrupt step which defines a forward facing abutment surface and a reduced thickness finger tab or release member which extends forwardly from the step to define a front end of the latch. As the drawer is being inserted, the step eventually slides past the frame member which permits the latching section to deflect outwardly back to an engagement position. This movement of the latching section to the engagement position occurs when the drawer is partially open and prevents complete reopening of the drawer since the abutment surface is now positioned for contact with an interior surface of the frame member.

The finger tab of the latching section, however, is dimensioned longitudinally so as to project forwardly beyond the cabinet frame member when the drawer is in the partially open position. Accordingly, the latch member is accessible from the exterior of the cabinet and can be manually pressed inwardly by the fingers of a user. When a user presses this finger tab or release member inwardly, the abutment surface is disengaged from contact with the frame member so as to thereafter permit the drawer to be slid outwardly to the fully opened position.

As a result, the inventive drawer latch is readily mountable to the exterior of the drawer so as to allow connection to existing cabinets. When installed, the drawer latch allows for uninterrupted rearward sliding of the drawer from an open position to a fully closed position, but once the abutment step is moved rearwardly past the corresponding frame member, the drawer can only be opened forwardly to a partially open position which prevents access to the contents of the drawer. Since the forward end of the drawer latch is accessible from the exterior of the drawer when the drawer is in the partially open position, an adult or older child can insert their fingers in the region between the front drawer wall and the frame member of the cabinet so that the drawer latch can be pressed inwardly to a disengaged position which allows for complete opening of the drawer.

Other objects and purposes of the invention will be apparent to persons familiar with assemblies of this general type upon reading the following specification and inspecting the accompanying drawings.

BRIEF DESCRIPTION OF THE DRAWINGS

FIG. 9 is a partial side elevational view in cross section of the drawer latch mounted to a bottom wall of the drawer; and FIG. 10 is a partial top plan view of the drawer latch mounted to the side wall of a drawer and engaged with the connector block which is mounted on the cabinet housing.

Figure 5:
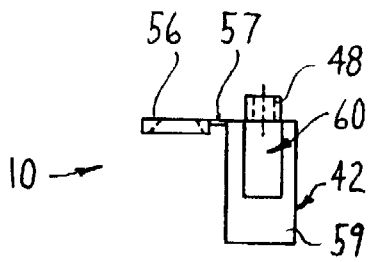
FIG. 5 is a right side elevational view of the drawer latch.
Figure 3:
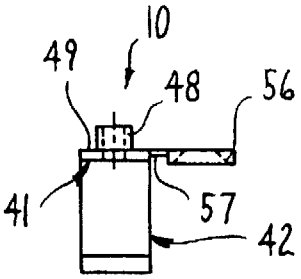
FIG. 3 is a left side elevational view of the drawer latch.
Figure 4:
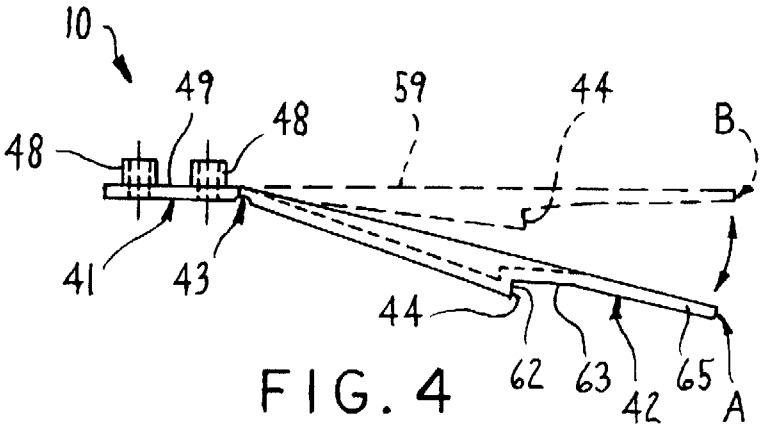
FIG. 4 is a front elevational view of the drawer latch.
Figure 1:
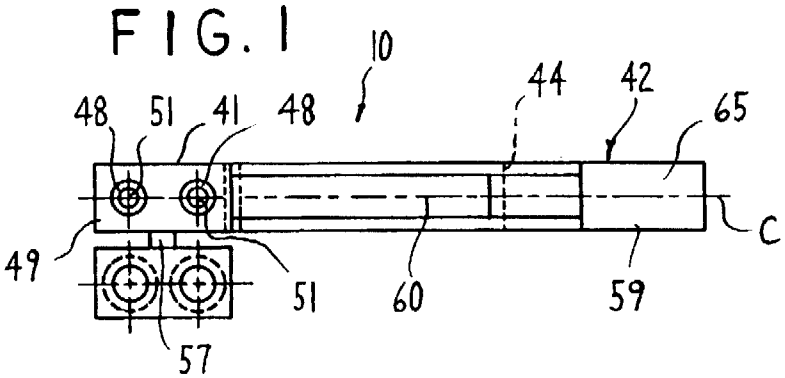
FIG. 1 is a top plan view of the drawer latch having a connector block attached thereto.
Figure 2:
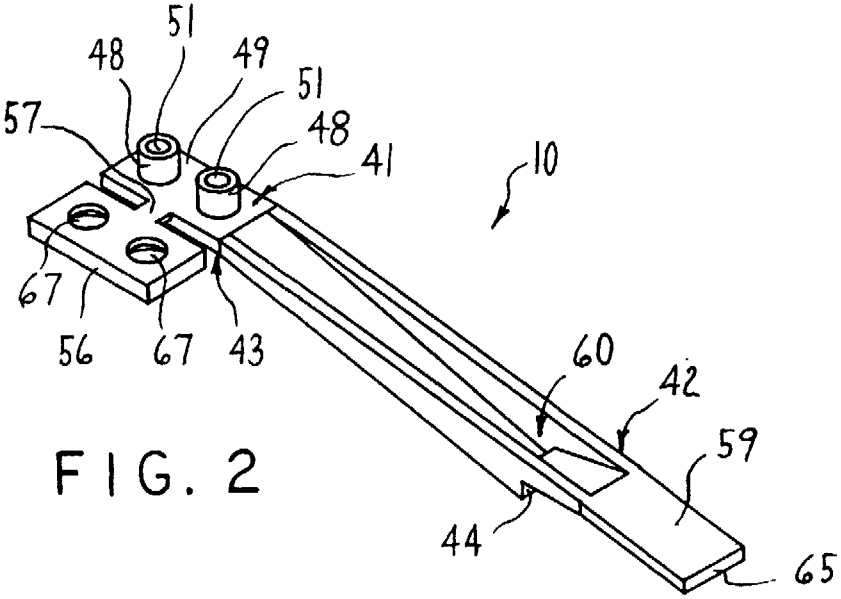
FIG. 2 is a front perspective view of the drawer latch.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1–6, the invention relates to a drawer latch 10 which is mountable to a drawer 12 (FIG. 6) and is resiliently deflectable between an engagement or latched position A (FIG. 4) and a disengagement or unlatched position B. The latch 10 flexes inwardly from the engagement position A to permit the drawer 12 to be inserted rearwardly into a cabinet housing 14 (FIG. 6), and once inserted, flexes back to the engagement position A as discussed in detail hereinafter for engaging-the cabinet housing 14 and preventing the drawer 12 from being completely opened unless the drawer latch 10 is manually disengaged by an adult or older child.

Figure 6:
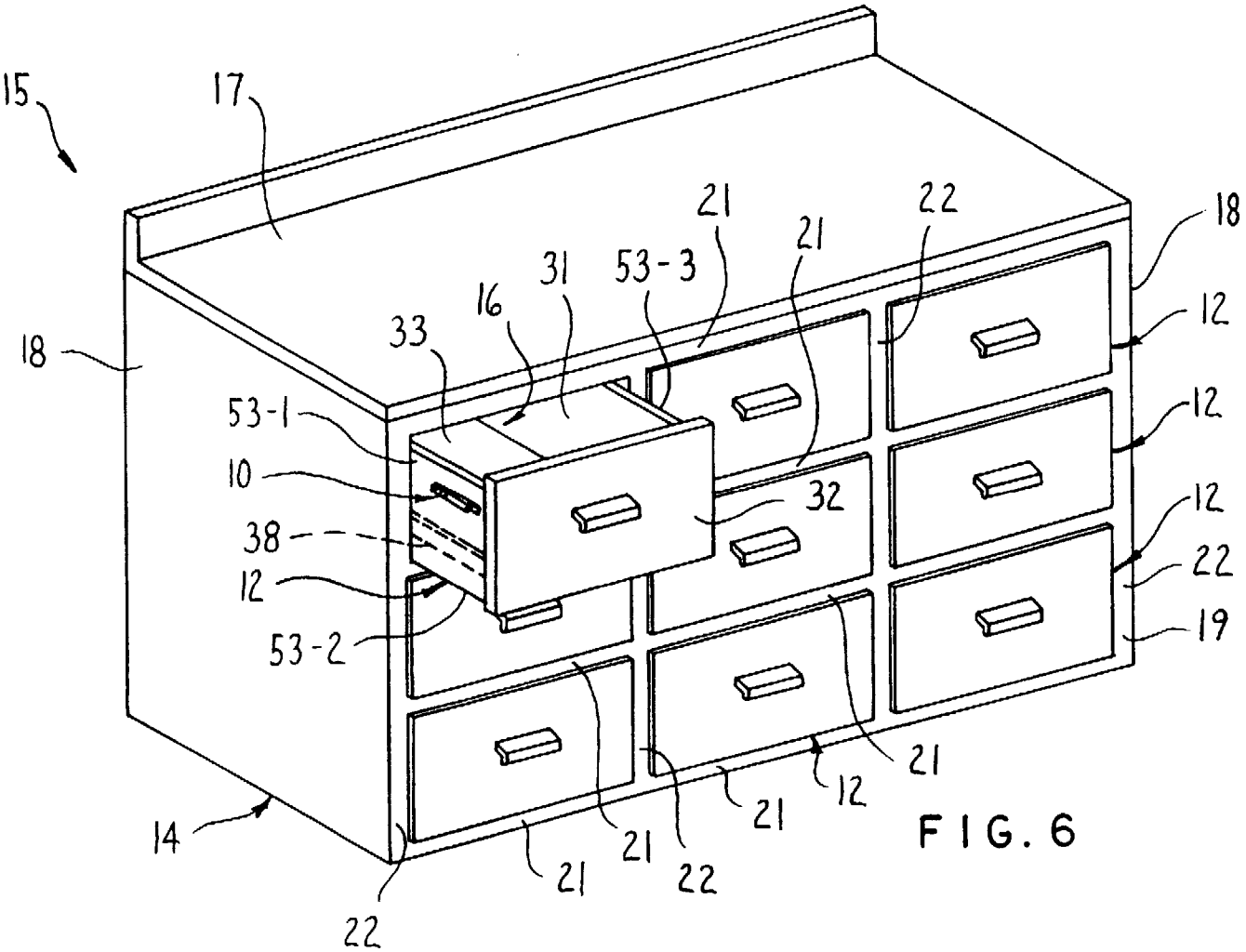
FIG. 6 is a front perspective view of a cabinet having a cabinet housing and drawers slidably inserted therein.
Figure 7:
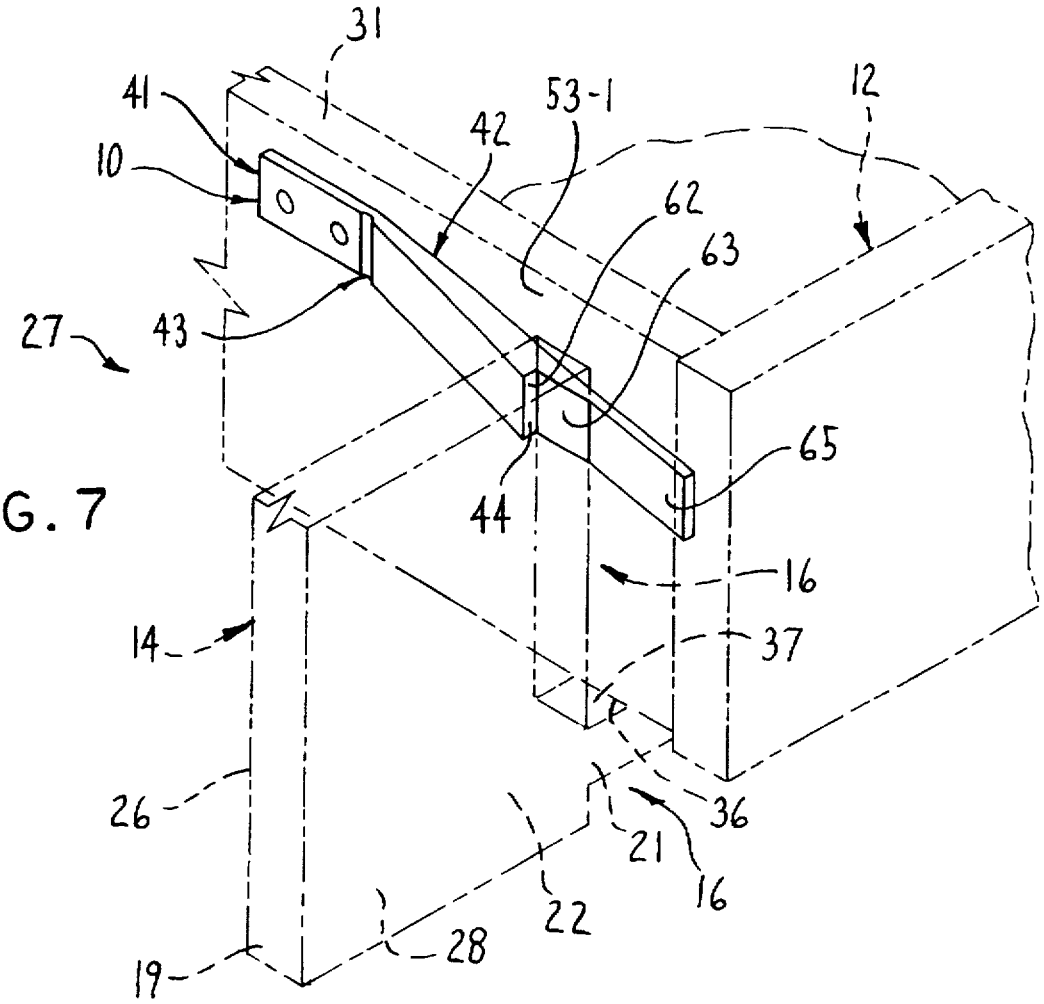
FIG. 7 is a partial perspective view of one of the drawers of FIG. 6 in a partially open position and the cabinet housing illustrated in phantom outline with the drawer latch engaged therebetween.

Referring to FIGS. 6 and 7, the drawer latch 10 is readily usable on conventional cabinets 15 as generally illustrated in FIG. 6 which may, for example, be located in the home or mobile vehicles including motor homes and boats. The cabinet 15 includes the cabinet housing 14 which defines a plurality of rectangular openings 16 in which the drawers 12 are slidably inserted. The cabinet housing 14 is of any conventional construction which typically includes a cabinet top 17, side walls or panels 18 and a front wall or face 19 which extends laterally between the side walls 18.

In the particular cabinet construction illustrated in FIGS. 6–10, the openings 16 are formed in horizontal rows and vertical columns through the front wall 19. The openings 16 are generally defined by horizontal cross members or frame members 21 which define the upper and lower edges thereof, and by vertical sections or frame members 22 which extend vertically between the top and bottom of the cabinet 15 and are disposed between each laterally adjacent pair of drawers 12 so as to define the left and right side edges of the openings 16. The front wall 19 includes an interior surface 26 (FIG. 8) which faces inwardly or rearwardly into a hollow interior 27 of the cabinet 15, and an exterior surface 28 which faces outwardly or forwardly to define the front exterior of the cabinet 15.

Each drawer 12 is of a conventional construction and generally includes a three-sided U-shaped side wall 31 which defines three sides of the drawer 12 namely, the left and right sides and the back of the drawer 12. The drawer 12 also includes a front wall 32 which extends laterally between the left and right sides of the side wall 31 to enclose the front of the drawer 12, and a rectangular bottom wall 33 which is connected to the side and back sections of the side wall 31 as well as the front wall 32 so as to enclose the bottom of the drawer 12. The drawer 12 is open on an upper side thereof to define a hollow interior or storage space 34 of the drawer.

Referring to FIGS. 7 and 9, a downward facing lower edge 36 of the side wall 31 extends downwardly below a bottom surface of the bottom wall 33 and is supported by an opposing upper edge 37 of the corresponding horizontal cross member 21 when the drawer 12 is inserted in the opening 16. The lower edge 36 of the side wall 31 is thereby slidably engaged with the upper edge 37 of the cross member 21 so as to support the drawer 12 within the cabinet housing 14. This type of support means for a drawer 12 is conventional. Alternatively, the drawer 12 can be supported within the cabinet housing 14 by telescoping drawer slides 38 which are mounted to the left and right side walls as generally illustrated in phantom outline in FIG. 6. Still further, a central rail (not illustrated) may be provided below the drawer 12 which extends rearwardly from the horizontal cross member 21 toward the back wall of the cabinet housing 14 and the bottom wall 33 of the drawer 12 may be provided with a connector block (not illustrated) which is slidably mated with the rail so as to provide an alternative method of supporting the drawer 12. The above-described methods of supporting a drawer 12 within a cabinet are conventional and a further more detailed discussion of such support means is not believed necessary.

In view of the foregoing, the drawer 12 is slidable into and out of the opening 16 so that the drawer 12 is movable between respective closed and opened positions as seen in FIG. 6.

Figure 8A:
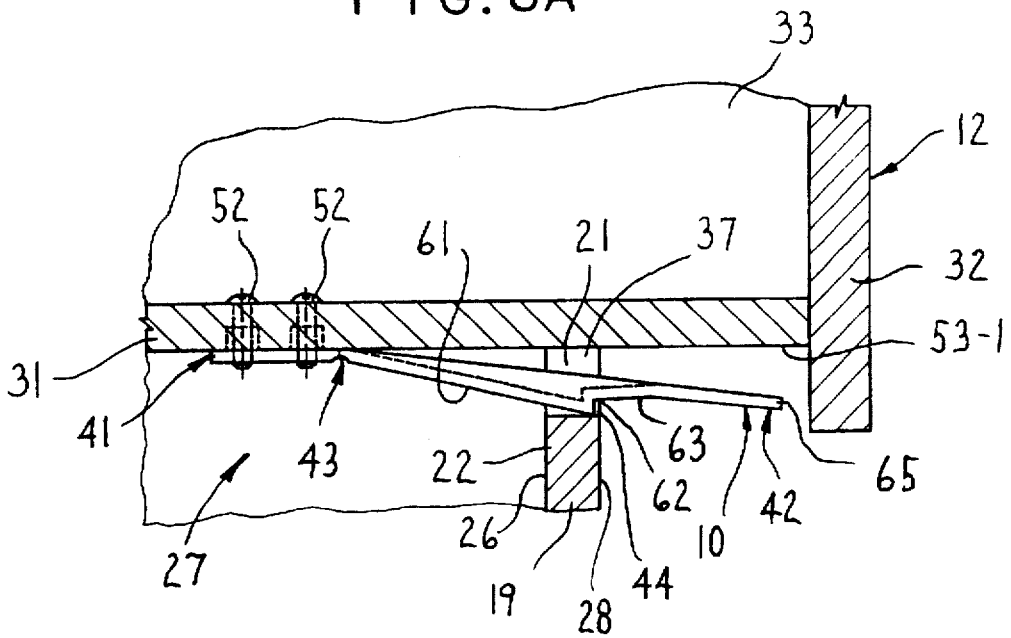
FIG. 8A is a partial top elevational view in cross section illustrating the drawer latch disengaged from the cabinet housing.
Figure 8B:
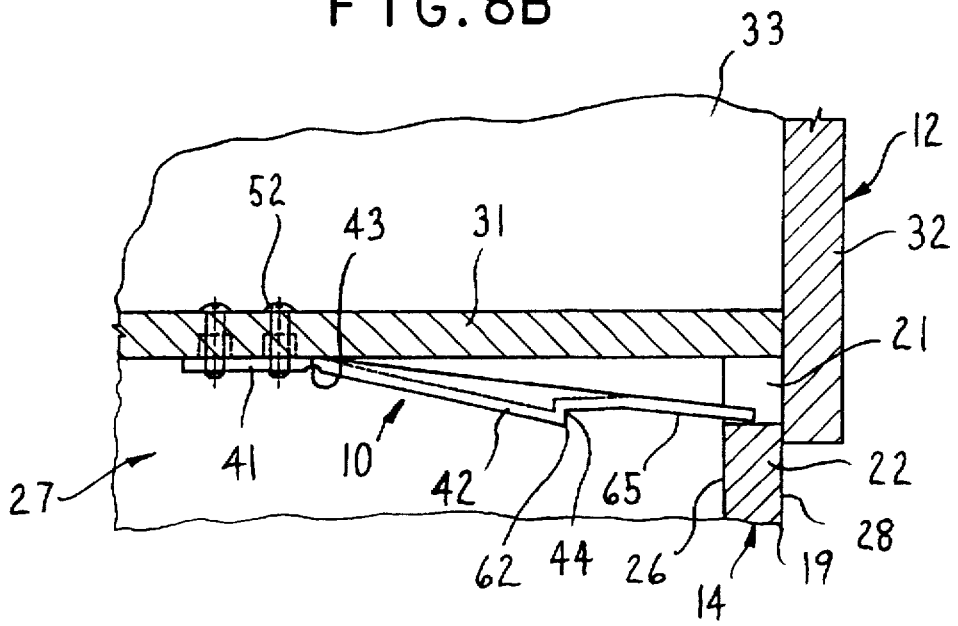
FIG. 8B is a partial top elevational view in cross section illustrating the drawer in a closed position.

Referring generally to the drawer latch 10, the drawer latch 10 is mounted to the drawer 12 by a mounting part or block 41 at one end thereof. The latch 10 further includes an elongate latching section 42 at an opposite end thereof which projects longitudinally and outwardly away from the mounting part 41 at an angle relative thereto for releasable abutting engagement with the interior surface 26 of the cabinet housing 14 as generally seen in FIG. 7 where the latch 10 is engaged with the vertical frame member 22, or FIG. 9 where the latch 10 is engaged with the horizontal frame member 21. The latching section 42 and the mounting part 41 are integrally joined together in cantilevered relation by a resiliently deflectable hinge section 43 so that the latching section 42 flexes relative to the mounting part 41. Also, the latching section 42 normally projects at an angle away from a surface of the drawer 12 to which the mounting part 41 connects and includes a stepped abutment 44 which faces in a forward direction so as to allow the latching section 42 to slide along the cabinet housing 14 until the drawer 12 is closed (FIG. 8B). Thereafter, the stepped abutment 44 prevents complete opening of the drawer 12 since it abuts against the opposing interior surface 26 of the cabinet housing 14 as generally seen in FIGS. 7 and 9. This thereby prevents unwanted opening of the drawer 12 and access to the drawer interior 34 by small children or unwanted opening of the drawer 12 by movement of a vehicle. To permit complete opening of the drawer 12, a forward end of the latching section 42 is manually pressed inwardly towards the drawer 12 by an adult or older child to disengage the drawer latch 10 from the cabinet housing 14.

More specifically, the drawer latch 10 is formed as a monolithic one-piece molded-plastic member. The mounting part 41 is formed as a substantially rectangular block having two cylindrical projections 48 which project away from a mating surface 49 on the mounting part 41. The projections 48 include cylindrical bores 51 formed coaxially therewith which extend completely through the mounting part 41. The bores 51 are adapted to threadedly engage fasteners 52 therein as generally illustrated in FIGS. 7–10 for the connection of the mounting part 41 to either the side wall 31 of the drawer 12 as seen in FIGS. 7 and 8 or the bottom wall 33 as seen in FIG. 9.

In both the side wall 31 or the bottom wall 33, two bores are formed therethrough which are adapted to receive the projections 48 through the exterior surfaces of the side wall 31 or the bottom wall 33. The fasteners 52 are inserted preferably from the drawer interior and threaded into the projections 48. The mounting section 41 is thereby mounted to the drawer 12 such that the latching section 42 is disposed rearwardly of but closely adjacent to the drawer front wall 32.

More particularly with respect to the connection of the latch 10 to the drawer 12, the drawer latch 10 is oriented so that the mounting part 41 is spaced rearwardly of the drawer front wall 32. The latching section 42 extends forwardly therefrom such that the longitudinal axis C (FIG. 1) of the drawer latch 10 is oriented generally parallel to the path along which the drawer 12 slides.

The side wall 31 or the bottom wall 33 respectively define exterior mounting surfaces 53-1 or 53-2 to which the latch 10 is connected. These mounting surfaces 53-1 or 53-2 are disposed closely adjacent to but spaced from a respective frame or edge member of the cabinet housing 14, namely, the vertical frame section 22 or the horizontal cross member 21 for ready engagement of the latching section 42 therewith. The latch 10 thereby can be readily connected to a suitable exterior surface of the drawer 12 so as to readily engage the adjacent frame member of the cabinet housing 14 so long as a suitable space is provided between the frame member and the drawer 12 to accommodate the drawer latch 10 therebetween. As a result, the latch 10 is mountable to the exterior of the drawer 12 at a wide variety of locations independent of the support means by which the drawer 12 is supported. Further, the latch 10 accordingly is not located within the drawer interior 34 which otherwise can interfere with the contents thereof.

The mounting section 41 also may be formed with an auxiliary connector block 56 which is removed prior to mounting on the drawer 12. The auxiliary connector block 56 is joined to the mounting part 41 by a breakable strap 57. The auxiliary connector block 56 permits use of the drawer latch 10 with flush surfaces of the cabinet housing 14 as will be described in more detail hereinafter with respect to the embodiment of FIG. 10. In the embodiments of FIGS. 6–9, however, the connector block 56 typically is detached from the mounting part 41 and not used.

Referring to FIGS. 1–8, the latching section 42 is connected to the mounting part 41 by a reduced thickness hinge section 43 which effectively defines a hinge axis extending transverse to the longitudinal axis C of the drawer latch 10. The hinge section 43 permits the latching section 42 to flex inwardly relative to the mounting section 41 to the disengagement position B, and thereafter returns the latching section 42 to the engagement position A due to the resiliency of the hinge material. Preferably, the latch 10 is molded from Celcon M270 Acetal plastic which provides the mounting section 41 and latching section 42 with sufficient rigidity while the hinge section 43 is resiliently flexible.

The latching section 42 projects forwardly and outwardly at an angle relative to the mating surface 49 of the mounting section 41 so as to angle outwardly away from the mounting surface 53-1 of the drawer 12. In particular, the latching section 42 includes an inner surface 59 which is adapted to be oriented flush against the drawer mounting surface 53-1 when flexed to the disengagement position B. The inner surface 59 also includes an inner cavity 60 opening therethrough.

To flex the latching section 42 inwardly when pushing the drawer 12 into the opening 16, a camming surface 61 is provided which faces outwardly away from the inner surface 59 and extends forwardly from the hinge section 43. The camming surface 61 and the inner surface 59 are formed at an angle one with respect to the other so that the latching section 42 has a tapered profile which increases in thickness away from the mounting section 41. The camming surface 61 extends a sufficient distance outwardly so as to contact the respective vertical or horizontal frame members 21 or 22 as the drawer 12 is pushed inwardly. As a result, the camming surface 61 deflects the latching section 42 inwardly away from the engagement position A as seen in FIG. 8A so that the drawer 12 is freely slidable to the closed position.

The latching section 42 also includes the stepped abutment 44 which is formed at the forward end of the camming surface 61 such that the latching section 42 has an abrupt reduction in thickness. The stepped abutment 44 defines a forward facing engagement surface 62 and an outward facing surface 63 which is disposed at substantially a right angle relative to the engagement surface 62 so as to define a seat which engages the opposing surfaces of the vertical frame member 21. More particularly, the engagement surface 62 is disposed so as to abut against the opposing interior surface 26 of the front wall 19 and prevent complete opening of the drawer 12 when in the engagement position A. The interior surface 26 thereby defines a stop surface for engagement with the stepped abutment 44. During opening, the drawer 12 is stopped in the partially open position (FIG. 7)

such that the front wall 19 thereof is spaced forwardly from the front cabinet wall 19. The space, however, is small enough to prevent access to the drawer interior 34.

To maintain a small outward pressure on the frame member 21 when the latching section 42 is engaged therewith, the latching section 42 preferably is dimensioned so as to be deflected inwardly a small amount by the frame member 21 when disposed in engagement therewith. This pressure serves to maintain secure engagement of the latching section 42 with the cabinet housing 14.

To effect disengagement of the latching section 42, a finger tab or release member 65 projects forwardly from the stepped abutment 44 and defines a front end of the latching section 42. In particular, the finger tab 65 projects forwardly beyond the exterior surface 28 of the front cabinet wall 19 when the drawer is stopped in the partially open position by the interior cabinet surface 26 as seen in FIG. 7. As a result, the front end of the latching section 42 defined by the finger tab 65 is accessible in the open space between the drawer front wall 32 and the cabinet front wall 19. A user can therefore reach into this gap from the side and press the finger tab 65 inwardly toward the mounting surface 53-1 of the drawer 12 so as to move the latching section 42 to the disengagement position B. Once the stepped abutment 44 is moved inwardly out of the way of the front wall 19 (FIG. 8A), the drawer 12 can thereafter be fully opened. When the drawer 12 is fully closed as seen in FIG. 8B, the finger tab 65 remains in contact with the vertical edge member 22 in the space between the edge member 22 and the mounting surface 53-1 so that the latch 10 is entirely within the cabinet housing 14.

In operation, the drawer latch 10 allows for uninterrupted rearward sliding of the drawer 12 from the open position to the fully closed position. In particular, the camming surface 61 contacts the edge of the vertical edge member 21 to deflect the latching section 42 inwardly and permit closing of the drawer 12 (FIG. 8A). As the stepped abutment 44 moves rearwardly past the interior surface 26 of the cabinet front wall 19, the latching section 42 snaps outwardly back to the engagement position A. Thereafter, sliding of the drawer 12 continues to the closed position (FIG. 8B).

While rearward sliding is permitted, the engagement surface 62 of the stepped abutment 44 stops forward opening of the drawer 12 upon contacting the interior cabinet surface 26. When the engagement surface 62 contacts the interior cabinet surface 26, the drawer 12 is in the partially open position (FIG. 7). While access to the drawer interior 34 is still prevented, the finger tab 65 projects outwardly of the opening 16 so as to be manually pressed by a user to move the latching section 42 to the disengaged position B for complete opening of the drawer 12.

While FIGS. 7, 8A and 8B illustrate the drawer latch 10 on one side surface of the drawer 12, a second drawer latch 10 (not illustrated) can be mounted to a mounting surface 53-3 (FIG. 6) on the opposite right side surface of the drawer 12 to provide a second mounting location for the drawer latch 10.

Alternatively, the drawer latch 10 can be mounted to the mounting surface 53-2 of the bottom drawer wall 33 as seen in FIG. 9. As a result, the engagement surface 62 abuts against and engages the interior surface 26 of the horizontal frame member 22. The drawer latch 10 is thereby disengagable by reaching under the drawer 10 to press the finger tab 65 upwardly to the disengagement position B. This drawer latch 10 otherwise operates the same as when the drawer latch 10 is mounted to the side mounting surfaces 53-1 and 53-2.

As can be seen, the drawer latch 10 can be mounted to any suitable mounting location on the drawer 12 which is sufficiently close to a frame or edge member of the cabinet housing 14 for engagement therewith but spaced sufficiently from the frame member so as to accommodate the drawer latch 10. At a minimum, the space between the mounting surface 53 and the frame member should be slightly greater than the thickness of the latching section 42 near the stepped abutment 44 since this will permit sliding of the latch 10 past the frame member when pressed against the mounting surface and also permit at least a small flexing of the latching section 42 outwardly into engagement with the frame member 21 or 22. Where such space is not wide enough, it also is possible to form a recess (not illustrated) in the exterior of the drawer 12 in which the latch 10 can be mounted. The stepped abutment 44 can then project at least partially out of the recess for engagement with a cabinet frame member when in the engagement position B.

Further, in some cabinets 15, the cabinet housing 14 may not have the interior surface 26 adjacent the drawer 12 for engagement with the latch 10 as is the case along the interior of the side wall 18 as seen in FIG. 10. In such an instance, the auxiliary connector block 56 discussed above may be used to define a stop surface. In particular, the connector block 56 (FIGS. 1–6) is removed from the mounting section 41 by breaking the strap 57. The connector block 56 includes apertures 67 formed therethrough and thus, the connector block 56 is fastened to the interior surface 68 of the side wall 18 by screws or other fasteners inserted through the apertures 67. The connector block 56 thereby serves the same function as the vertical and horizontal frame members 21 and 22 in that it serves as an edge member and provides an opposing stop surface 69 which engages the stepped abutment 44 to stop the drawer 12 during opening thereof as seen in FIG. 10. The finger tab 56 is thereafter pressed toward the drawer 12 to disengage the drawer latch 10 and permit opening of the drawer 12 as previously described herein.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a cabinet housing having a cabinet wall which has a forward facing surface, at least one opening formed through said cabinet wall, and a cabinet component slidably received through said opening, said cabinet component and said cabinet housing including support means for slidably supporting said cabinet component in said cabinet housing so as to be slidable between an open position extending outwardly of said cabinet wall and a closed position disposed substantially within an interior of said cabinet housing, comprising the improvement wherein said cabinet component includes spaced apart side walls and a bottom wall which define exterior surfaces of said cabinet component and a front wall which extends between said side walls, said cabinet housing including an edge member disposed adjacent to one of said exterior surfaces, latch means being mounted to said one exterior surface proximate said front wall for releasably engaging said edge member to prevent opening of said cabinet component past a partially open position, said cabinet component being movable from said closed position to said partially open position a distance which is a small fraction of the distance between the open and closed positions, said latch means having a rear latch section connected to said exterior surface and a front latch section which extends outwardly and forwardly away from said rear latch section and is hingedly connected to said rear latch section so as to be movable inwardly from an engagement position to a disengagement position, said front latch section including a forward facing engagement surface which engages said edge member when in said engagement position to prevent said opening of said cabinet component past said partially open position, said latch means further including a release member which extends forwardly from said engagement surface, said front latch section and said release member being spaced outwardly away from said rear latch section, said release member being disposed rearwardly of said front wall and extending forwardly past said edge member when said cabinet component is in said partially open position so as to be accessible between said cabinet housing and said front wall from an exterior thereof to permit manual movement of said front latch section to said disengagement position to disengage said latching means from said edge member and permit sliding of said cabinet component to said open position.

2. A cabinet housing according to claim 1, wherein said rear latch section of said latch means has a rearward end which is removably mountable to said cabinet component separate and independent from said support means for said cabinet component.

3. A cabinet housing according to claim 2, wherein said engagement surface is disengaged from said edge member when said cabinet component is moved rearwardly past said partially open position to said closed position.

4. A cabinet housing according to claim 2, wherein said engagement surface engages an opposing stop surface of said edge member.

5. A cabinet housing according to claim 1, wherein said latch means is disposed rearwardly of said front wall of said cabinet component and is disposed entirely within said cabinet housing when said cabinet component is in said closed position.

6. A cabinet housing according to claim 1, wherein said release member contacts said edge member when said cabinet component is disposed in said closed position and is freely slidable along said edge member during reversible movement of said cabinet component between said closed and partially open positions.

7. In a cabinet housing having at least one opening formed through a front wall thereof which opens into an interior of said cabinet, and a drawer slidably received through said opening, said drawer and said cabinet housing including support means for slidably supporting said drawer on said cabinet housing so that said drawer is slidable forwardly to an open position extending outwardly of said front wall and rearwardly to a closed position disposed substantially within said interior, said drawer including a drawer front wall, side walls extending rearwardly from said drawer front wall and a horizontal bottom wall enclosing a bottom of said drawer, said cabinet front wall including an edge member defining at least one edge of said opening, comprising the improvement wherein said edge member is disposed closely adjacent an outward facing mounting surface of said drawer which is defined by an exterior surface of one of said side and bottom walls, said edge member including a first surface facing toward said drawer in opposing relation with said mounting surface and an interior second surface which is oriented transverse to said first surface and faces rearwardly toward said cabinet interior, a drawer latch removably mounted to said mounting surface for preventing opening of said drawer past a partially open position wherein access to said drawer is prevented, said drawer latch being disposed rearwardly of said drawer front wall and being formed as an elongate one-piece member which includes a mounting section at a rearward end and a latching section at a forward end thereof, said mounting section including connection means for removably connecting said drawer latch to said mounting surface in non-interfering relation with said edge member, said latching section extending forwardly away from said mounting section at an angle relative to said mounting surface and being integrally joined to said mounting section by a resiliently deflectable hinge section so as to be deflectable inwardly toward said mounting surface from an engagement position to a disengagement position, said latching section including a camming surface which is slidable along said edge member as said drawer is moved rearwardly to the closed position to flex said latch section inwardly from said engagement position, a stepped abutment surface at a forward end of said camming surface, and an elongate release member which projects forwardly from said abutment surface, said abutment surface facing forwardly so as to abut against said interior second surface of said edge member when disposed in said engagement position to prevent complete opening of said drawer and define said partially open position, said release member projecting through said opening and beyond said edge member when said abutment surface is engaged therewith in said partially open position, said abutment surface and said release member being spaced outwardly from said mounting section, a forward end of said release member being accessible from an exterior of the cabinet housing when said drawer is in said partially open position to permit manual flexing of said latch section to said disengagement position to disengage said abutment surface from said edge member and permit sliding of said drawer to said open position said release member being disposed proximate said drawer front wall so as to press outwardly against said first surface of said edge member when said drawer is in said closed position.

8. A cabinet housing according to claim 7, wherein said drawer latch is mountable to said drawer separate and independent from said support means for said drawer.

9. A cabinet housing according to claim 7, wherein said drawer is slidable rearwardly past said partially open position to said closed position, said drawer latch permitting said rearward sliding of said drawer and preventing forward sliding of said drawer past said partially open position when in said engagement position.

10. A cabinet housing according to claim 7, wherein said hinge section has a reduced thickness relative to said mounting section and said latching section.

11. A cabinet housing according to claim 7, wherein said drawer latch is disposed entirely within said cabinet housing when said drawer is in said closed position.

12. A cabinet housing according to claim 7, wherein said edge member is one of a vertical frame member defining a vertical edge of said opening and a horizontal frame member defining a horizontal edge of said opening.

13. An elongate drawer latch mounted to an exterior surface of a drawer and said drawer being movable relative to a stop member between extended and retracted positions, said drawer latch comprising:

a mounting section defining a rearward end of said drawer latch, said mounting section including mounting means for connecting said mounting section to the exterior drawer surface of the drawer such that an inward facing first surface of said mounting section is disposed in opposing relation with said exterior drawer surface;

a hinge section integrally formed with said mounting section at a forward edge thereof, said hinge section defining a hinge axis extending transverse to a longitudinal axis of said drawer latch; and a latching section having a rearward end integrally formed with said hinge section so as to be angularly deflectable about said hinge axis between an engagement position and an inwardly deflected disengagement position, said latching section extending forwardly away from said mounting section along said longitudinal axis and having on one side a second inner surface normally disposed at an angle relative to said mounting section when in said engagement position, and on an opposite side a first outer surface opposite said second inner surface which includes a stepped abutment spaced forwardly from said hinge section, said stepped abutment being defined by a forward facing abutment surface which extends inwardly and is disposed transverse to an outward facing mating surface which extends forwardly therefrom, said abutment surface and said mating surface being substantially parallel to and abutting respectively against opposing surfaces of said stop member when said latching section is in said engagement position, said latching section including a release member which extends forwardly from said stepped abutment to define a forward end of said latching section and which extends forwardly away from said stop member when said latching section is in said engagement position to permit manual pressing of said release member inwardly to deflect said latching section to said disengagement position, said release member defining an outward facing second outer surface proximate a free end thereof which is substantially flat so as to be free of outwardly extending projections forwardly of said stepped abutment, said second outer surface contacting said stop member when said drawer is in said retracted position;

said drawer latch being a unitary one-piece construction formed from a non-metal resilient material.

14. A drawer latch according to claim 13, wherein said first outer surface of said latching section defines an outward facing camming surface extending between said hinge section and said stepped abutment, said camming surface extending forwardly at an angle relative to said second inner surface.

15. A drawer latch according to claim 14, wherein said release member has a reduced thickness relative to a thickness of said latching section defined by said camming surface and said second inner surface.

16. A drawer latch according to claim 15, wherein said mounting section has a length which is less than the length of said latching section, said mounting section including at least one bore extending through said inward facing first surface and having a fastener threadedly engaged therein, said fastener adapted to be engaged with an exterior surface of a drawer.

17. A drawer latch according to claim 13, wherein said hinge section has a reduced thickness relative to said forward end of said mounting section and said rearward end of said latching section.

18. A drawer latch according to claim 17, wherein said drawer latch is of a plastic material.

19. A drawer latch according to claim 13, wherein said second outer surface angles outwardly and forwardly away from said mating surface when disposed in said engagement position.

20. A drawer latch according to claim 19, wherein said abutment surface and said mating surface are disposed substantially perpendicular relative to each other, and said mating surface is substantially parallel to said exterior drawer surface when said latching section is in said engagement position.

* * * * *